US006124580A

United States Patent [19]

Nottmeier et al.

[11] Patent Number: 6,124,580

[45] Date of Patent: Sep. 26, 2000

[54] SCREED FOR A PAVER HAVING A TAMPER BAR HEATED BY INDUCTION

[75] Inventors: Cord Nottmeier, Rinteln; Hans-Joachim Komm, Hameln, both of Germany

[73] Assignee: ABG Allgemeine Baumaschinen-Gesellschaft mbH, Hameln, Germany

[21] Appl. No.: 09/336,475

[22] Filed: Jun. 18, 1999

[30] Foreign Application Priority Data

Jun. 20, 1998 [DE] Germany ..... 198 27 577

[51] Int. Cl.[7] ..... H05B 6/10; E01C 19/48

[52] U.S. Cl. ..... 219/635; 219/618; 219/676; 404/95; 404/118; 404/133.05

[58] Field of Search ..... 219/635, 618, 219/670, 676, 672; 404/95, 118, 114, 133.05, 133.2

[56] References Cited

U.S. PATENT DOCUMENTS 3,613,530 10/1971 Hess .

FOREIGN PATENT DOCUMENTS

| | | | |
|---|---|---|---|
| 0 641 887 | 3/1995 | European Pat. Off. . | |
| 62-200119 | 9/1987 | Japan | 219/635 |
| 63-186700 | 8/1988 | Japan | 219/635 |
| 10-252012 | 9/1998 | Japan . | |

*Primary Examiner*—Philip H. Leung
*Attorney, Agent, or Firm*—Mark A. Ussai

[57] ABSTRACT

A screed for a paver has a baseplate and at least one tamper bar arranged in front of the baseplate. The tamper bar extends transversely to the paving direction and is movable in upward and downward directions by means of an eccentric drive and is capable of being electrically heated. At least one coil is provided, which is arranged so as to be adjacent to the tamper bar and to which a high-frequency current may be applied by means of an electrical current source. The current flowing through the coil induces eddy currents in the tamper bar such that the tamper bar becomes heated.

17 Claims, 1 Drawing Sheet

SCREED FOR A PAVER HAVING A TAMPER BAR HEATED BY INDUCTION

BACKGROUND OF THE INVENTION

The present invention relates to screeds for pavers, and more particularly to paver screeds having tamper bars and devices for heating the tamper bars.

Paving machines or pavers generally include a mobile frame, a screed arranged at the rear (i.e., with respect to the "laying" or paving direction) of the frame, and a distributor auger located between the frame and screed. The screed is typically articulated on the paver frame by means of a pair of tension arms, so that the screed "floats" on the paving material being laid by the paver.

Floating screeds of this type are known, such as for example in EP 0,641,887 Al. The screed assembly disclosed in the EP 0,641,887 Al patent includes a tamper bar configured to be movable in upward and downward directions and arranged in front (i.e, with respect to the paving direction) of a baseplate so as to extend transversely to the paving direction. The tamper bar is capable of being driven by means of an eccentric drive and is electrically heatable via a heating element, for example a resistance heating bar. The tamper bar includes at least one wearing part, in other words the member that performs the compacting, and at least one carrier part, such as for example, one or more connecting rods. Further, the tamper bar includes at least one channel for receiving the heating element, the channel being formed in the wearing part, in the carrier part or between the wearing part and carrier part. The heating element is located in the channel and is thus moved up and down together with the tamper bar when the screed is in operation.

To provide electricity to the heating element, "supply lines" in the form of wires, cables, etc., extend between the heating element on the tamper and an electrical current source located on the screed or otherwise on the paver. Due to the fact that these wires or cables must move with the tamper as it reciprocates upwardly and downwardly, frequent operating faults occur with these supply lines.

The object of the present invention is to provide a screed for a paver in which the device for heating of the tamper bar is designed to be less susceptible to faults.

SUMMARY OF THE INVENTION

For this purpose, in a screed with a baseplate which, if appropriate, is coupled to a vibrating drive and in front of which, as seen in the paving direction, is arranged at least one tamper bar which extends transversely to the paving direction and is movable up and down by means of a drive. The tamper bar is capable of being electrically heated via at least one coil arranged so as to be adjacent to the tamper bar. A high-frequency current may be applied to the coil via a current source, and when a high-frequency current flows through the coil, eddy currents are induced in the tamper bar. The tamper bar preferably forms a short circuit or conduit for the magnetic field generated by the coil.

The coil(s) are each preferably disposed about a U-shaped magnetizable core that is disposed such that the tamper bar forms the yoke for the core. Alternatively, the coil(s) may be designed as an air-core coil, a ring coil with a sufficient turn or winding interval or a bar-shaped coil, with the geometry of any such coil(s) being adapted to the respective conditions of use and space. The current source may be an alternating-current source or a three phase current source, and the source may be followed by a frequency converter.

The tamper bar behaves as an electrical conductor in which eddy currents are induced via a magnetic flux. The high-frequency current flowing through the coils generates a magnetic field which changes periodically in direction and which induces eddy currents in the tamper bar.

The screed may alternatively include two tamper bars arranged adjacent to one another, one behind the other with respect to the paving direction. With two tamper bars, the tamper bar located at the front with respect to the paving direction performs pre-compaction of paving material. Electrical heating of the front tamper bar may be accomplished by means of at least one coil arranged on or disposed proximal to the front wall of the screed, while the heating of the rear tamper bar is carried out by means of at least one coil arranged on the baseplate, as described above.

Other embodiments of the invention may be gathered from the following description and the subclaim.

BRIEF DESCRIPTION OF THE SEVERAL VIEWS OF THE DRAWINGS

The foregoing summary, as well as the detailed description of the preferred embodiments of the invention, will be better understood when read in conjunction with the appended drawings. For the purpose of illustrating the invention, there is shown in the drawings, which are diagrammatic, embodiments that are presently preferred. It should be understood, however, that the invention is not limited to the precise arrangements and instrumentalities shown. In the drawings.

DETAILED DESCRIPTION OF THE INVENTION

Certain terminology is used in the following description for convenience only and is not limiting. The phrase "paving direction" refers to the direction of travel of a paving machine during a paving operation. The words "front", "frontward" and "rear", "rearward" refer to directions toward and away from, respectively, the paving direction. The terminology includes the words specifically mentioned above, derivatives thereof, and words of similar import.

Figure 1:
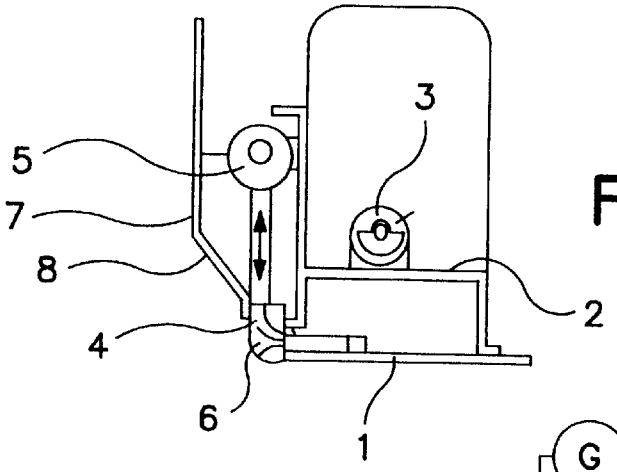
FIG. 1 is a side plan view of a screed for a paver in accordance with the present invention.
Figure 2:
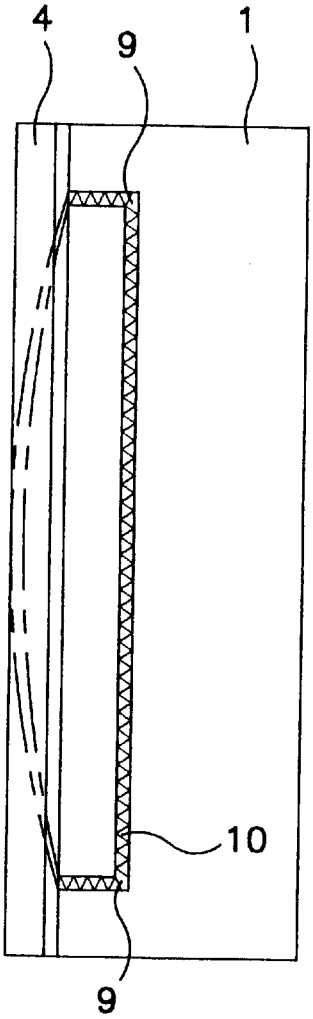
FIG. 2 is a top plan view of the compacting elements of the screed of FIG. 1, showing a first embodiment of an electrical heating device.
Figure 3:
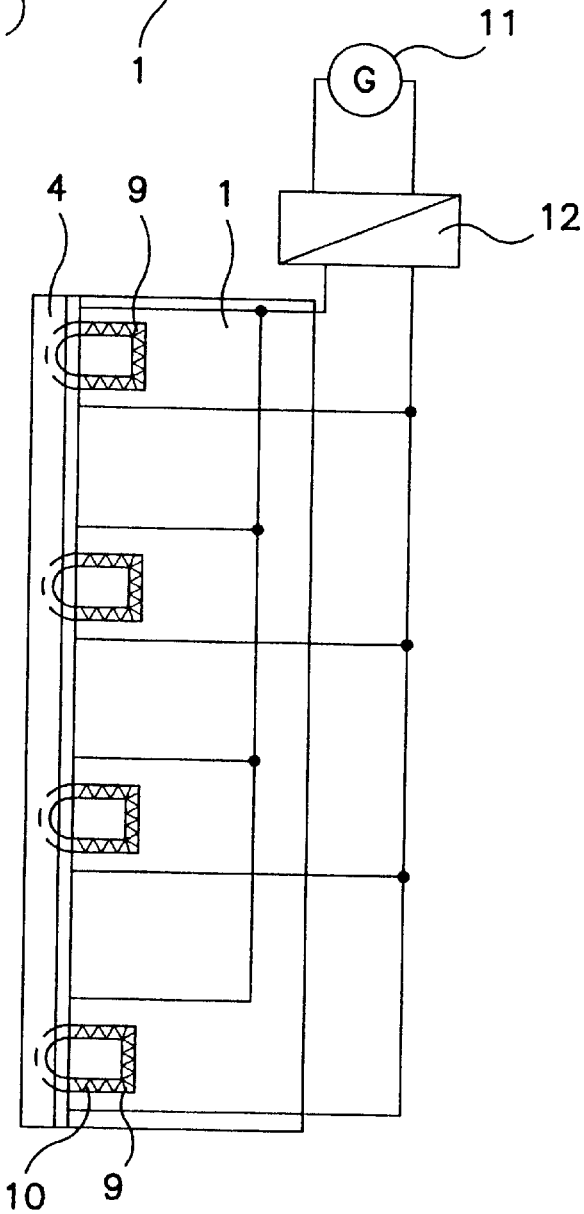
FIG. 3 is a top plan view of the compacting elements of the screed, showing an alternative embodiment of the heating device.

Referring now to the drawings in detail, wherein like numbers are used to indicate like elements throughout, there is shown in FIGS. 1–3 an improved screed for a paver in accordance with the present invention. The screed comprises a baseplate 1 which is configured to float on paving material laid upon a base surface A and to "smooth" or level and compact the paving material on a base surface (not shown), such as for example a roadway or roadbed, as is well known to those skilled in the construction art, and particularly in the paving art. The base plate 1 is connected, preferably by means of a carrier 2, to a vibrating shaft 3 coupled to a vibratory drive (not depicted).

The screed also includes a tamper bar 4 arranged in front of the baseplate 1 and extending generally transversely to the paving direction over substantially the entire width of the baseplate 1. The tamper bar 4 is configured to be driven so as to move alternately in upward and downward directions (i.e., generally toward and away from the base surface). Preferably, the tamper bar 4 is driven by an eccentric drive 5 and is configured to be adjustably displaceable by the amount of an adjustable stroke of the eccentric drive 5. Further, the tamper bar 4 has a lead-in slope 6 located at the front edge of the bar 4. The angle of the lead-in slope 6 is preferably between 30° and 70°, so as to ensure an optimum feed of the paving material.

Furthermore, the screed has a front wall 7 disposed proximal to a distributor auger (not shown), the distributor auger functioning to spread paving material falling off the end of a conveyor mounted on the paver (neither shown) generally across the width of the screed. The front wall 7 includes a lower guide portion 8 which is preferably inclined relative to the tamper bar 4 and which terminates adjacent to the bar 4, such that the guide portion 8 directs paving material from the auger (not shown) to the tamper bar 4. The angle of inclination of the guide portion 8 preferably corresponds approximately to the angle of the lead-in slope 6 of the tamper bar 4.

The screed of the present invention further includes an electrical heating device in the form of one coil 10 (FIG. 2) or alternatively as a plurality of coils 10 (FIG. 3), such coils being known in the electronics arts. Preferably, each coil 10 is disposed about a "U-shaped" magnetizable core 9 arranged or disposed on the top or upper side of the baseplate 1. Alternatively, the coils 10 may be designed as air-core coils (i.e., without a separate core member), ring coils or bar-shaped coils. For example, if ring coils are used for the coil(s) 10, the interval or spacing of adjacent coil windings must sufficiently large so that the magnetic field surrounding the coil wire is sufficient to induce eddy currents in the tamper bar 4, as discussed below for coils 10 having a U-shaped core 9.

With the preferred coil(s) 10 having a U-shaped magnetizable core 9, the tamper bar 4 preferably forms a yoke for the core 9, and thus a "short circuit" or conduit for the magnetic field generated by the coil 10. The U-shaped core 9 may be surrounded either completely or partially by the coil 10. Further, the U-shape of the magnetizable core 9 may be modified to include a middle leg (not shown) upon which the coil 10 or a portion thereof may be disposed. Preferably, the magnetizable core 9 is constructed of a ferrite material as ferrites have low electrical conductivity, and thus only very small eddy-current losses occur in the material, while also having high permeability (and thus being easier to magnetize).

As depicted in FIG. 2, when the screed includes only a single coil 10, the coil 10 preferably extends along substantially the entire length (i.e., transversely with respect to the paver direction) of the tamper bar 4. With a plurality of coils 10 as shown in FIG. 3, the coils 10 are preferably arranged equidistantly from one another and spaced transversely with respect to the paving direction so as to be distributed along the length of the tamper bar 4. Further, the plurality of coils 10 are arranged on the baseplate 1 so that the U-shaped core 9 of each coil 10 is disposed with the free ends of the core 9 being located adjacent to the tamper bar 4 (and thus proximal to the front edge of the baseplate 1), so that a separate, proximal portion of the tamper bar 4 forms a yoke for each core 9 of the coils 10, as shown in FIG. 3.

Preferably, for the plurality of coils 10 as depicted in FIG. 3, the coils 10 are electrically connected, in parallel with each other, to a common electric current source 11. The single coil 10 shown in FIG. 2 is correspondingly connected to an electric current source (not depicted) generally similar to the source 11 depicted in FIG. 3 and discussed below. The current source 11 is preferably an alternating-current ("AC") source or a three-phase current source. Further, the current source 11 may be "followed" by a frequency converter 12, in other words, a frequency converter 12 may be electrically connected between the current source 11 and the coil(s) 10.

The high frequency current flowing in the coils 10 generates a magnetic field which fluctuates or changes (i.e., reverses) periodically in direction. As a result of the changing or fluctuating magnetic field, eddy currents are induced in the tamper bar 4, with the result that the tamper bar 4 becomes heated. In order to minimize magnetic field losses, and thus to maximize heating efficiency, the coils 10 are preferably arranged at a short distance from each component (e.g, the tamper bar 4) to be heated. The preceding principles are known to those skilled in the art of electronics and/or applied physics, such that a detailed recitation herein of these principles is unnecessary and beyond the scope of the present disclosure.

In addition to the tamper bar 4, the baseplate 1 may also be electrically heatable. The electrical heating of the baseplate 1 may be accomplished, for example, by means of resistance heating or by means of one or more heating cartridges or heating bars (i.e., ohmic heating elements). Further, the baseplate 1 may also be heated electromagnetically in a manner similar to the heating of the tamper bar 4 as described above.

Preferably, if electromagnetic heating of the baseplate 1 is desired, one or more additional coils (not shown) may be arranged on the baseplate 1 for this purpose, which are most preferably ring coils. In this case, the interval of the coil windings must be selected to be sufficiently large so that the magnetic field surrounding the coil wire is sufficient to induce eddy currents in the baseplate 1. However, the coils may alternatively have a U-shaped magnetizable core 9 or be designed as air-core coils. The additional coils on the baseplate 1 are electrically connected to either the electrical current source 11 or to a separate current source (not shown), so that a high-frequency current is applied to these coils. As discussed above with the coils 10, the periodic change or fluctuation of the magnetic field existing about the additional coils when high-frequency current flows therethrough will induce eddy currents in the baseplate 1, with the result that the baseplate 1 becomes heated.

As it is desired to heat only the tamper bar 4 and/or the baseplate 1 without heating other portions of the screed, it is preferable to ensure that eddy currents occur only in those particular regions or portions of the screed where heating is desired. To accomplish this purpose, the coils 10 may be shielded magnetically relative to screed portions where no heating is desired by known appropriate means.

As an alternative to a screed having a single tamper bar 4, the screed may include two tamper bars (not shown), preferably arranged one behind the other with respect to the paving direction. With two tamper bars, the front tamper bar (not depicted) pre-compacts the paving material, and the following or rear tamper bar 4 further compacts the paving material. Preferably, such a "double tamper bar" screed includes one or more additional coils 10 (not depicted), most preferably disposed on or proximal to the front wall 7, arranged adjacent to the front tamper bar so as to be capable of heating the front tamper bar in the manner discussed above with the single tamper bar 4. Preferably, these additional coil(s) 10 are each disposed about a U-shaped magnetizable core 9, with the core 9 being arranged so that at least a portion of the front tamper bar forms a yoke for the core 9. The heating of the front tamper bar is accomplished in a manner similar to that discussed above, in other words, by inducing eddy currents in the front tamper bar (not shown) in reaction to a periodically changing magnetic field generated by high-frequency current flowing through the additional coils 10.

The amount of heating of the tamper bar 4 and/or of the baseplate 1 may be regulated in any appropriate manner, such as for example, in a secondary or primary regulatable manner or controllably via a control loop or via a thermostat with two-step regulation and/or via frequency regulation.

With the screed according to the present invention, the coils 10 of the tamper heating device may be used to bring the tamper bar 4 to a temperature considerably above the normal working temperature of the tamper bar 4, which is normally in the range of 120 to 140° C., by a corresponding increase in the current capacity applied by the coils. Such a degree of heating of the tamper bar 4 will soften or loosen bitumen or asphalt paving material which has penetrated into spaces adjacent to the tamper bar during a paving operation and which has cooled (and thus hardened) as a result of a standstill of the paver, for example overnight. In this way, bitumen/asphalt which has hardened in the region of the tamper bar 4 becomes softened again and, if appropriate, loosened, so that the period of time until the screed is able to be put into operation again is reduced.

The screed of the present invention has apparent advantages over previous screeds having resistance element(s) mounted on the tamper and connected by cabling or wiring to a current source located elsewhere on the screed. With a screed having coils 10, there are no cables or wires that must move along with the tamper bar during screed operation, therefore eliminating one source of problems that may adversely affect screed operation. Furthermore, with a paver having a screed in accordance with the present invention, the design outlay is lower, since the tamper bar does not require a channel for a heating element.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A screed for a paver, the paver being movable in a paving direction, the screed comprising:

a baseplate;

a tamper bar arranged proximal to the baseplate, the tamper bar extending transversely to the paving direction and being movable in upward and downward directions and relative to the baseplate;

a coil connected with the baseplate and disposed generally adjacent to and spaced from the tamper bar; and an electric current source electrically connected with the coil;

wherein the current source applies a high-frequency electric current to the coil so as to induce eddy currents in the tamper bar to thereby heat the tamper bar as the tamper bar moves with respect to the coil.

2. The screed according to claim 1, wherein the tamper bar forms a conduit for a magnetic field generated by the coil.

3. The screed according to claim 1, wherein the coil has a magnetizable U-shaped core.

4. The screed according to claim 1, wherein the screed includes a plurality of coils arranged equidistantly from one another and spaced transversely with respect to the paving direction.

5. The screed according to claim 1, wherein the coil is disposed on the baseplate.

6. The screed according to claim 1, wherein the screed includes another tamper bar, the two tamper bars being arranged adjacent to one another with one bar being located behind the other bar with respect to the paving direction.

7. The screed according to claim 1, wherein the screed includes a front wall and the coil is arranged on the front wall.

8. The screed according to claim 1 further including a frequency converter electrically connected between the current source and the coil.

9. The screed according to claim 1, wherein the current source is an alternating-current source.

10. The screed according to claim 1, wherein the current source is a three-phase current source.

11. The screed according to claim 1, wherein the coil is insulated from portions of the screed where heating is not desired.

12. The screed according to claim 1, wherein the baseplate is electrically heatable.

13. The screed according to claim 1, wherein another coil is arranged adjacent to the baseplate so as to induce eddy currents in the baseplate.

14. The screed according to claim 13, wherein the other coil is a ring coil.

15. The screed according to claim 1, further comprising a thermostat disposed on one of the tamper bar and the baseplate.

16. The screed according to claim 1, further comprising a vibrating drive coupled with the baseplate.

17. A screed for a paver, comprising a baseplate which, if appropriate, is coupled to a vibrating drive and in front of which, as seen in the paving direction, is arranged at least one tamper bar which extends transversely to the laying direction and is movable up and down and relative to the baseplate by means of a drive and which is capable of being electrically heated, characterized in that at least one coil is provided, which is connected with the baseplate and arranged so as to-be adjacent to and spaced from the tamper bar and to which a high-frequency current can be applied via a current source, the current inducing eddy currents in the tamper bar to thereby heat the tamper bar as the tamper bar moves with respect to the coil.

* * * * *

UNITED STATES PATENT AND TRADEMARK OFFICE

CERTIFICATE OF CORRECTION

PATENT NO. : 6,124,580
DATED : September 26, 2000
INVENTOR(S) : Cord Nottmier, Hans-Joachim Komm It is certified that error appears in the above-identified patent and that said Letters Patent is hereby corrected as shown below:

Please correct Fig. 1 as follows:

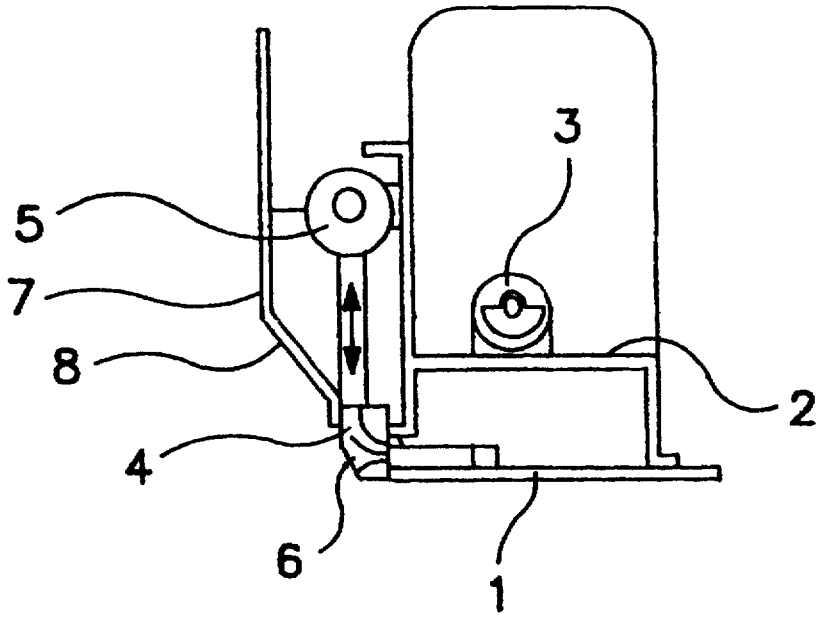

Signed and Sealed this

Thirtieth Day of October, 2001

*Attest:*

Nicholas P. Godici

NICHOLAS P. GODICI
*Acting Director of the United States Patent and Trademark Office*

*Attesting Officer*